US006685432B2

(12) United States Patent
Chen

(10) Patent No.: US 6,685,432 B2
(45) Date of Patent: Feb. 3, 2004

(54) HUB ASSEMBLY FOR MARINE PROPELLER

(75) Inventor: Liheng Chen, Schaumburg, IL (US)

(73) Assignee: Turning Point Propellers Inc., Elk Grove Village, IL (US)

( * ) Notice: Subject to any disclaimer, the term of this patent is extended or adjusted under 35 U.S.C. 154(b) by 0 days.

(21) Appl. No.: 10/241,951

(22) Filed: Sep. 12, 2002

(65) Prior Publication Data

US 2003/0012652 A1 Jan. 16, 2003

Related U.S. Application Data

(62) Division of application No. 09/753,366, filed on Jan. 2, 2001, now Pat. No. 6,471,481.

(51) Int. Cl.[7] ..... B63H 1/20

(52) U.S. Cl. ..... 416/134 R; 416/170 R; 416/244 B; 464/90; 464/91

(58) Field of Search ..... 416/134 R, 170 R, 416/204 R, 244 R, 245 A, 244 B; 464/90, 74, 75, 91

(56) References Cited

U.S. PATENT DOCUMENTS

| | | | | |
|---|---|---|---|---|
| 2,235,605 | A | 3/1941 | Bugatti | |
| 2,469,116 | A | 5/1949 | Kiekhaefer | |
| 2,556,151 | A | 6/1951 | Bremer | |
| 2,956,187 | A | 10/1960 | Wood | |
| 3,002,365 | A | 10/1961 | Liljequist | |
| 3,045,763 | A | 7/1962 | Perrott | |
| 3,701,611 | A | 10/1972 | Lambrecht | |
| 4,338,064 | A | 7/1982 | Carmel | |
| 4,452,591 | A | 6/1984 | Fishbaugh et al. | |
| 4,566,855 | A | 1/1986 | Costabile et al. | |
| 4,642,057 | A | 2/1987 | Frazzell et al. | |
| 4,826,404 | A | 5/1989 | Zwicky | |
| 4,898,552 | A | 2/1990 | Cochran | |
| 5,049,034 | A | 9/1991 | Cahoon | |
| 5,201,679 | A | 4/1993 | Velte, Jr. et al. | |
| 5,244,348 | A | 9/1993 | Karls et al. | |
| 5,252,028 | A | 10/1993 | LoBosco et al. | |
| 5,322,416 | A | 6/1994 | Karls et al. | |
| 5,908,284 | A | 6/1999 | Lin | |
| 5,967,751 | A | 10/1999 | Chen | |
| 6,471,481 | B2 * | 10/2002 | Chen | 416/134 R |

* cited by examiner

*Primary Examiner*—Ninh H. Nguyen
(74) *Attorney, Agent, or Firm*—Boyle Fredrickson Newholm Stein & Gratz S.C.

(57) ABSTRACT

A propeller assembly is provided for mounting in a rotatable propeller shaft of a water craft. The propeller assembly includes a hub structure extending along an axis and including an outer surface having a plurality of circumferentially spaced blades projecting therefrom and an inner surface having a plurality of circumferentially spaced, longitudinally extending keys projecting therefrom. An adaptor translates rotatational movement of the propeller shaft to the hub structure. The adaptor includes an inner surface defining a passageway for receiving a propeller shaft therethrough and an outer surface having a plurality of circumferentially spaced, longitudinally extending keys extending therefrom. The keys of the hub structure and the keys of the adaptor lie on a generally circular key path such that rotation of the adaptor is directly translated to the hub structure.

15 Claims, 2 Drawing Sheets

FIG. 2
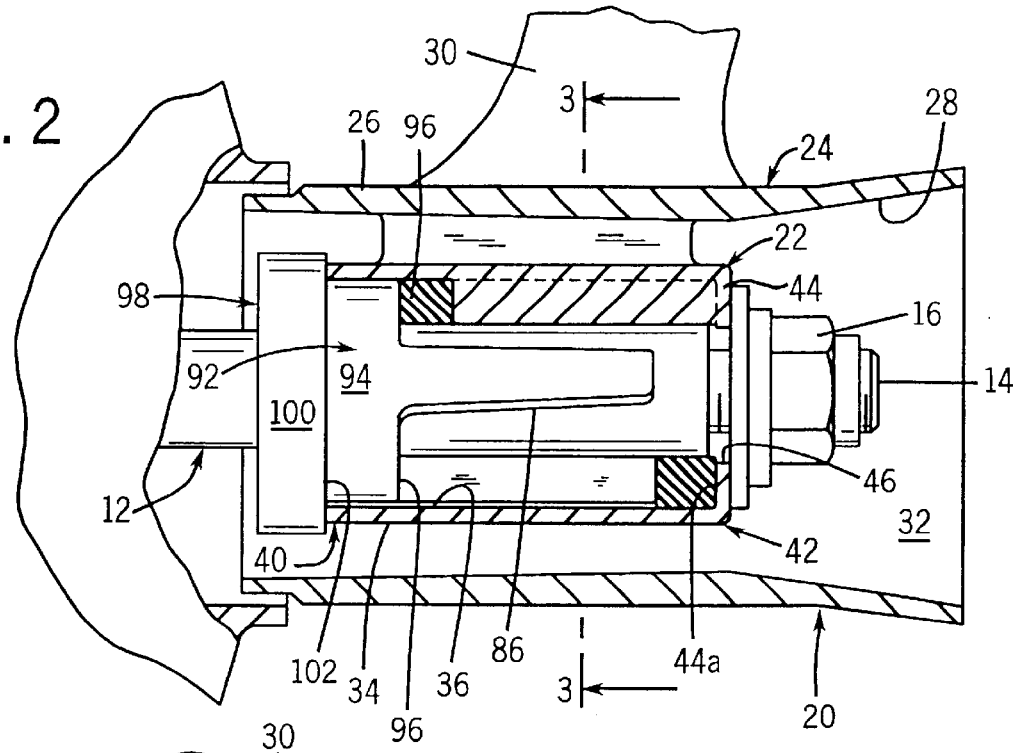
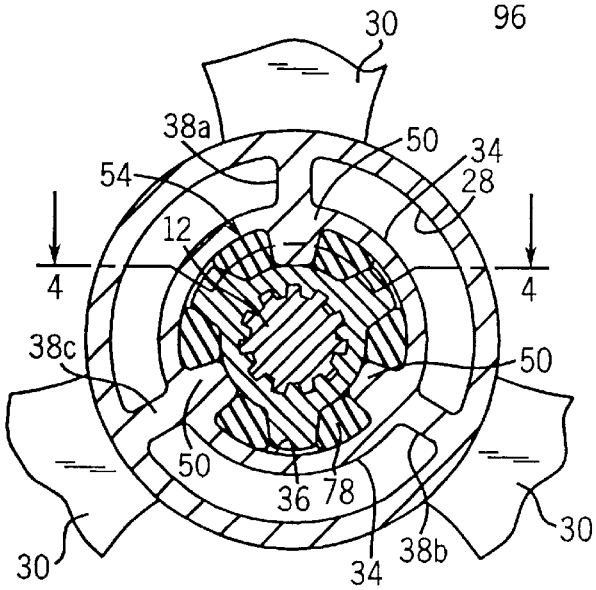
FIG. 3
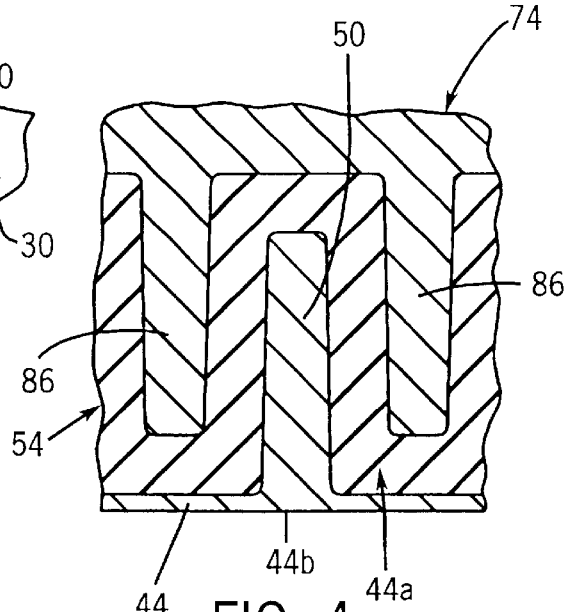
FIG. 4

HUB ASSEMBLY FOR MARINE PROPELLER

RELATED APPLICATION

This application is a divisional application of Ser. No. 09/753,366, filed Jan. 2, 2001, now U.S. Pat. No. 6,471,481 and entitled "HUB ASSEMBLY FOR MARINE PROPELLER."

FIELD OF THE INVENTION

This invention relates to propellers, and in particular, to a hub assembly for translating rotational movement from a propeller shaft of a marine vehicle to the blades of a propeller.

BACKGROUND AND SUMMARY OF THE INVENTION

It is known to propel a marine vehicle utilizing a propeller assembly mounted on a rotatable shaft. The propeller assembly includes propeller blades extending from a central hub. A motor rotates the drive shaft which, in turn, rotates the central hub and the propeller blades. A hub assembly is provided to interconnect the central hub to the drive shaft. As is known, rotation of the propeller blades extending from the central hub propels the marine vehicle through the water.

Typically, the propeller assembly is constructed as a unit wherein the propeller blades, the central hub and the hub assembly are mounted or removed from the drive shaft in unison. Typically, the central hub of the propeller assembly includes an outer cylindrical housing which is welded or otherwise attached to a plurality of propeller blades. The central hub also includes an inner cylindrical housing which is co-axial with the outer cylindrical housing and radially spaced therefrom. The inner housing is supported within the outer housing by a plurality of circumferentially spaced ribs. The propeller assembly further includes a hub assembly disposed within the inner cylindrical housing of the propeller hub assembly. The hub assembly includes a drive member having an inner surface which meshes with splines on the outer surface of the drive shaft and an outer surface. A bushing formed from a rubber or elastomeric material is provided between the inner surface of the inner housing and the outer surface of the drive member. The elastomeric bushing provides shock absorbency between the propeller hub assembly and the drive shaft.

It has been found that slippage may occur between the elastomeric bushing and the inner surface of the inner housing. Once slippage has occurred, the outer surface of the elastomeric bushing becomes more common. Consequently, once slippage has occurred, it becomes necessary to replace the propeller assembly in order to once again realize the power capabilities of the motor of the marine vehicle.

In addition, it is known that the drive shafts driven by the various motors for marine vehicles differ depending upon the manufacture. Consequently, individual propellers must be provided for the drive shafts of each motor brand. Maintaining an inventory of specific propellers for each brand of motor requires significant storage space and may be cost prohibitive.

Therefore, it is a primary object and feature of the present invention to provide a hub assembly for a propeller which discourages slippage between the coupling element and the inner surface of the inner housing.

It is a still further object and feature of the present invention to provide a hub assembly for a propeller which may be easily adapted for mounting propellers on the drive shafts of different manufacturers' motors.

It is a still further object and feature of the present invention to provide a hub assembly for a propeller which is simple and inexpensive to manufacture.

In accordance with the present invention, a propeller assembly is provided for mounting on a rotatable propeller shaft of a watercraft. The propeller assembly includes a hub structure extending along a longitudinal axis. The hub structure includes an outer surface having a plurality of circumferentially spaced blades projecting therefrom and an inner surface having a longitudinally extending key projecting therefrom. The key is a predetermined distance from the longitudinal axis. The propeller assembly also includes an adaptor having an inner surface defining a passageway for receiving the propeller shaft therethrough and an outer surface having a longitudinally extending key extending therealong. The key of the adaptor is also the predetermined distance from the longitudinal axis.

The propeller assembly may also include a tubular bushing about the adaptor. The bushing has a portion disposed between the key of the hub structure and the key of the adaptor. The tubular bushing includes an inner surface engageable with the outer surface of the adaptor and an outer surface engageable with the inner surface of the hub structure. It is contemplated to form the tubular bushing from a resilient material.

In accordance with the further aspect of the present invention, a propeller assembly is provided for mounting on a rotatable propeller shaft of a watercraft. The propeller assembly includes a hub structure extending along a longitudinal axis. The hub structure includes an outer surface and an inner surface having a longitudinally extending key projecting therefrom. The propeller assembly also includes an adaptor having an inner surface defining a passageway for receiving the propeller shaft therethrough and an outer surface having a longitudinally extending key extending therealong. The key of the hub structure and the key of the adaptor lie on a generally circular key path. The key path having a predetermined radius.

A tubular bushing may be positioned about the adaptor. The tubular bushing includes a portion disposed between the key of the hub structure and the key of the adaptor. In addition, the tubular bushing includes an inner surface engageable with the outer surface of the adaptor and an outer surface engageable with the inner surface of the hub structure. It is contemplated that the tubular bushing be formed from a resilient material.

The inner surface of the adaptor may include splines to mesh with the splines on the rotatable propeller shaft of the watercraft. The outer surface of the hub structure includes a plurality of circumferentially spaced blades projecting therefrom.

In accordance with a still further aspect of the present invention, a propeller assembly is provided for mounting on a rotatable propeller shaft of a watercraft. The propeller assembly includes a hub structure extending along a longitudinal axis. The hub structure includes an outer surface and an inner surface having a plurality of circumferentially spaced, longitudinally extending keys projecting therefrom. The propeller assembly also includes an adaptor having an inner surface defining a passageway for receiving the propeller shaft therethrough and an outer surface having a plurality of circumferentially spaced, longitudinally extending keys extending therealong. Each key of the adaptor is disposed between the corresponding pair of keys projecting from the inner surface of the hub structure.

The outer surface of the hub structure includes a plurality of circumferentially spaced blades projecting therefrom. A tubular bushing may be provided about the adaptor. The tubular bushing includes a plurality of bushing portions. Each bushing portion is disposed between a key projecting from the outer surface of the adaptor and a corresponding key projecting from the inner surface of the hub structure. The tubular bushing also includes an inner surface engageable with the outer surface of the adaptor and an outer surface engageable with the inner surface of the hub structure. It is contemplated to form the tubular bushing from a resilient material.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 2 is a side elevational view, partially in section, showing the propeller assembly of the present invention;

FIG. 3 is a cross-sectional view of the propeller assembly of the present invention taken along line 3—3 of FIG. 2; and FIG. 4 is a cross-sectional view of the propeller assembly of the present invention taken along line 4—4 of FIG. 3.

DETAILED DESCRIPTION OF THE DRAWINGS

Figure 1:
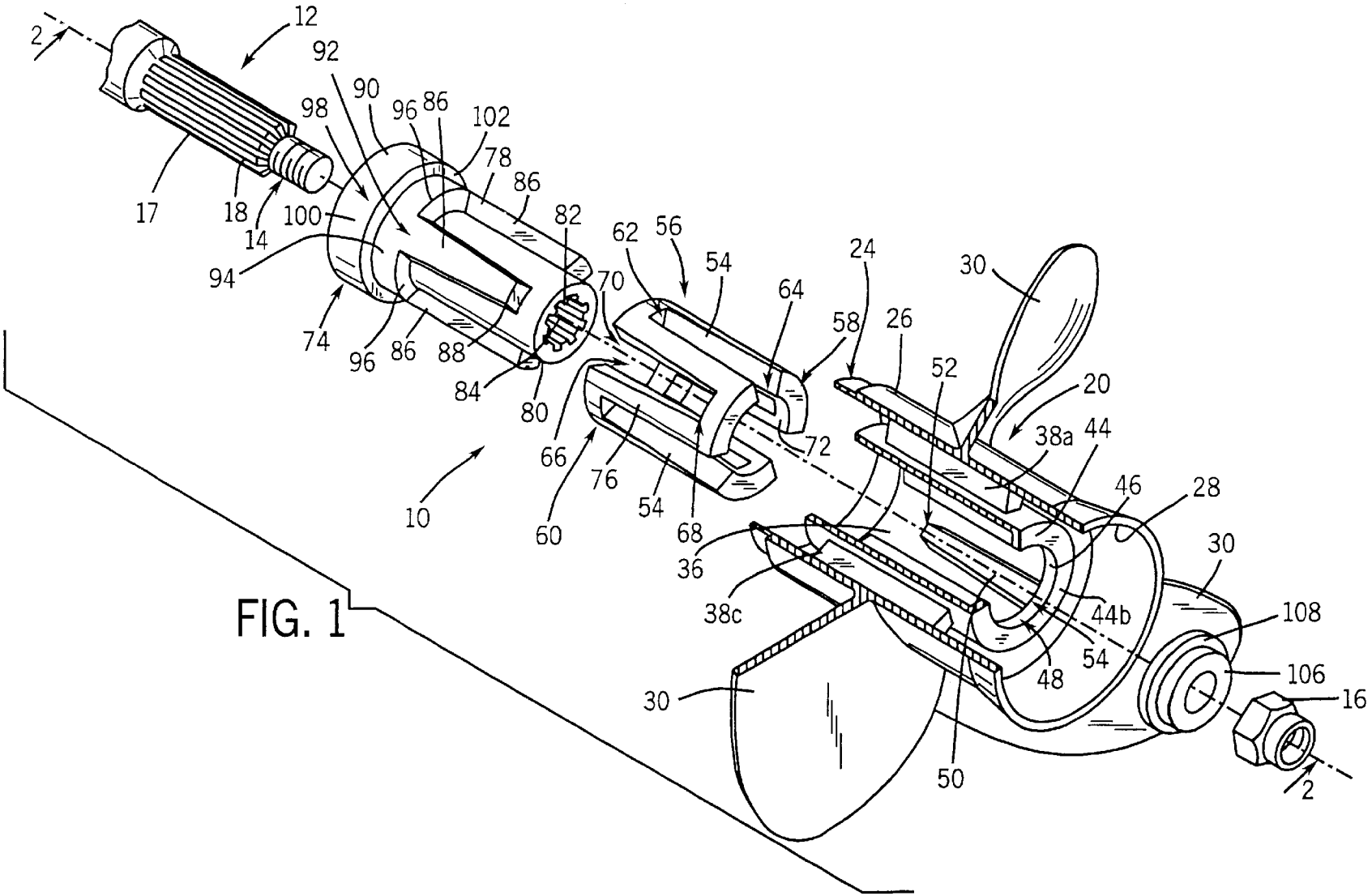
FIG. 1 is an exploded, isometric view of a propeller assembly in accordance with the present invention.

Referring to FIG. 1, a propeller assembly in accordance with the present invention is generally designated by the reference numeral 10. It is intended that propeller assembly 10 be mounted on a rotatable propeller shaft 12 which, in turn, is driven by a marine engine (not shown). Propeller shaft 12 extends along a longitudinal axis and terminates at a threaded terminal end 14 adapted for receiving a locking nut 16 thereon, for reasons hereinafter described. As is conventional, rotatable shaft 12 includes an outer surface 17 having longitudinally extending splines 18 therealong adjacent terminal end 14.

Referring to FIGS. 1 and 2, propeller assembly 10 includes a central hub 20 having an inner cylindrical housing 22 and an outer cylindrical housing 24. Outer housing 24 has an outer surface 26 and an inner surface 28. A plurality of circumferentially spaced propeller blades 30 project radially from outer surface 26 of outer housing 24. Inner surface 28 defines an inner housing receipt cavity 32.

Inner housing 22 is received within inner housing receipt cavity 32 defined by outer housing 24. Inner housing 22 includes an outer surface 34 and an inner surface 36. A plurality of circumferentially spaced connection spokes 38*a–c* extend between the outer surface 24 of inner housing 22 and the inner surface 28 of outer housing 24 so as to rigidly connect inner housing 22 to outer housing 24.

Inner housing 22 has a first end 40 and a second, opposite end 42. An end flange 44 projects radially inward from second end 42 of inner housing 22 and terminates at a radially inner surface 46 which defines a generally circular opening 48 in second end 42 of inner housing 22.

Inner surface 36 of inner housing 22 includes a plurality of circumferentially spaced, axially-extending keys 50. Each key 50 includes a first narrow end 52 and an opposite wider end 54 which abuts surface 44*a* of end flange 44 of inner housing 22. Keys 50 are dimensioned for receipt in corresponding inner housing keyways 54 in bushing 56.

Bushing 56 is formed from a resilient material and has first and second opposite ends 58 and 60, respectively. Each inner housing keyway 54 is defined by a first closed end 62 and a second open end 64 which is generally co-planar with first end 58 of bushing 56. It is contemplated that inner housing keyway 54 be narrower at closed end 62 than at open end 64 thereof such that inner housing keyways 54 may receive corresponding keys 50 along the inner surface 36 of inner housing 22 in a mating relationship.

Bushing 56 further includes a plurality of adaptor keyways 66. Each adaptor keyway 66 includes a first closed end 68 and a second open end 70 which is generally coplanar with second end 60 of bushing 56. It is contemplated that each adaptor keyway 66 be narrower at closed end 68 than at open end 70.

Bushing 56 includes an inner surface 72 which defines a passageway therethrough for receiving adaptor 74. Bushing 56 further includes an outer surface 76 which engages the inner surface 36 of inner housing 22, for reasons hereinafter described.

Adaptor 74 includes an outer surface 78 and an inner surface 80 which defines a passage 84 therethrough for receiving the splined portion of propeller shaft 12. Inner surface 80 of adaptor 74 includes a plurality of circumferentially spaced, longitudinally extending splines 82 therealong which mesh with splines 18 extending along propeller shaft 12. Outer surface 78 of adaptor 74 includes a plurality of circumferentially spaced, axially extending keys 86 projecting therefrom. Each key 86 includes a narrow end 88 and a wider end 90. Keys 86 of adaptor 74 are dimensioned for receipt in corresponding adaptor keyways 66 in bushing 56.

Adaptor 74 further includes a stop member 92 which extends radially from outer surface 78 and terminates at a radially outer surface 94. Stop member 92 includes a radially extending stop surfaces 96 which project radially from outer surface 78 of adaptor 74 to outer surface 94. Radially-extending stop surfaces 96 extend between wider ends 90 of keys 86. Enlarged head 98 is formed adjacent stop member 92 of adaptor 74 and has a radially outer surface 100. Outer surface 100 of enlarged head 98 is radially spaced from outer surface 94 of stop member 92 by radially-extending sidewall 102.

In order to mount propeller assembly 10 on propeller shaft 12, propeller shaft 12 is inserted through passage 84 in adaptor 74 such that splines 18 along outer surface 17 of propeller shaft 12 mesh with corresponding splines 82 along the inner surface 80 of adaptor 74. Bushing 56 is slid axially onto adaptor 74 such that keys 86 extending along outer surface 78 of adaptor 74 are received within corresponding adaptor keyways 66 in bushing 56. Bushing 56 is slid onto adaptor 74 until such point that second end 60 of bushing 56 engages stop surfaces 96 of stop member 92. It can be appreciated that such construction prevents keys 86 of adaptor 74 from becoming wedged within corresponding adaptor keyways 66 in bushing 56. Central hub 20 is slid axially onto bushing 56 such that keys 50 extending along the inner surface 36 in bushing 56 such that first end 40 of inner housing 22 abuts sidewall 102 of enlarged head 98 of adaptor 74. Central hub 20 is slid onto bushing 56 until such point that first end 58 of bushing 56 engages surface 44*a* of flange member 44.

With central hub 20 received on bushing 56, terminal end 14 of propeller shaft 12 extends through opening 48 defined by flange 44 of inner housing 22. Washer 106 is positioned on terminal end 14 of propeller shaft 12 such that an enlarged portion 108 of washer 106 overlaps opening 48 and engages outer surface 44*b* of flange 44 of inner housing 22. Locking nut 16 is threaded onto end 14 of propeller shaft 12 to secure propeller assembly 10 on propeller shaft 12. It is contemplated to reverse washer 106 such that a portion of washer 106 extends into opening 48 and such that enlarged portion 108 of washer opening 48 and engages outer surface 44*b* of flange 44 of inner housing 22. As a result, washer 106 axially aligns propeller shaft 12 through inner housing 22.

It can be appreciated that propeller assembly 10 may be assembled as heretofore described prior to the mounting thereof on propeller shaft 12. In such manner, adaptor 74 may be modified so as to adapt to various types of propeller shafts 12 produced by different manufacturers. In other words, utilizing a modified adaptor 74, propeller assembly 10 may be mounted on each of the various types of propeller shafts.

In operation, propeller shaft 12 is rotated by the motor of the marine vehicle. As propeller shaft 12 is rotated, such rotation is translated to propeller assembly 10 through bushing 56 and adaptor 74 combination as heretofore described. Rotation of the propeller blades 30 projecting from the outer surface 26 of outer housing 24 propels the marine vehicle through the water.

Various modes of carrying out the invention are contemplated as being within the scope of the following claims particularly pointing out and distinctly claiming the subject matter which is regarded as the invention.

I claim:

1. A propeller assembly for mounting on a rotatable propeller shaft of a watercraft, comprising:

a hub structure extending along a longitudinal axis and including an outer surface having a plurality of circumferentially spaced blades projecting therefrom and an inner surface having a longitudinally extending key projecting therefrom, the key having a portion that is a predetermined distance from the longitudinal axis;

an adaptor having an inner surface defining a passageway for receiving the propeller shaft therethrough and an outer surface having a longitudinally extending key extending therealong, the key of the adaptor having a portion that is the predetermined distance from the longitudinal axis; and a tubular bushing about the adaptor, the tubular bushing having a portion disposed between the key of the hub and the key of the adaptor.

2. The propeller assembly of claim 1 wherein the tubular bushing includes an inner surface engageable with the outer surface of the adaptor and an outer surface engageable with the inner surface of the hub structure.

3. The propeller assembly of claim 1 wherein the tubular bushing is formed from a resilient material.

4. The propeller assembly of claim 1 wherein the inner surface of the adaptor includes splines.

5. A propeller assembly for mounting on a rotatable propeller shaft of a watercraft, comprising:

a hub structure extending along a longitudinal axis, the hub structure including an outer surface and an inner surface having a longitudinally extending key projecting therefrom;

an adaptor having an inner surface defining a passageway for receiving the propeller shaft therethrough and an outer surface having a longitudinally extending key extending therealong; and a tubular bushing about the adaptor, the tubular bushing having a portion disposed between the key of the hub structure and the key of the adaptor, wherein the key of the hub structure and the key of the adaptor lie on a generally circular key path, the key path having a predetermined radius.

6. The propeller assembly of claim 5, wherein the tubular bushing includes an inner surface engageable with the outer surface of the adaptor and an outer surface engageable with the inner surface of the hub structure.

7. The propeller assembly of claim 5 wherein the tubular bushing is formed from a resilient material.

8. The propeller assembly of claim 5 wherein the inner surface of the adaptor includes splines.

9. The propeller assembly of claim 5 wherein the outer surface of the hub structure has a plurality of circumferentially spaced blades projecting therefrom.

10. A propeller assembly for mounting on a rotatable propeller shaft of a watercraft, comprising:

a hub structure extending along a longitudinal axis, the hub structure including an outer surface and an inner surface having a plurality of circumferentially spaced, longitudinally extending keys projecting therefrom;

an adaptor having an inner surface defining a passageway for receiving the propeller shaft therethrough and an outer surface having a plurality of circumferentially spaced, longitudinally extending keys extending therealong, each key of the adaptor disposed between a corresponding pair of keys projecting from the inner surface of the hub structure; and a tubular bushing about the adaptor.

11. The propeller assembly of claim 10 wherein the outer surface of the hub structure includes a plurality of circumferentially spaced blades projecting therefrom.

12. The propeller assembly of claim 10 wherein the tubular bushing includes a plurality of a bushing portions, each bushing portion disposed between a key projecting from the outer surface of the adaptor and a corresponding key projecting from the inner surface of the hub structure.

13. The propeller assembly of claim 10 wherein the tubular bushing includes an inner surface engageable with the outer surface of the adaptor and an outer surface engageable with the inner surface of the hub structure.

14. The propeller assembly of claim 10 wherein the tubular bushing is formed from a resilient material.

15. The propeller assembly of claim 10 wherein the inner surface of the adaptor includes splines.

* * * * *